US008238201B2

(12) United States Patent
Martinez et al.

(10) Patent No.: US 8,238,201 B2
(45) Date of Patent: Aug. 7, 2012

(54) MODULAR TIMEPIECE MOVEMENT

(75) Inventors: Daniel Martinez, La Chaux-de-Fonds (CH); Franck-Charles-Cyril Orny, La Chaux-de-Fonds (CH); Johnny Frederic Girardin, Fontaines (CH)

(73) Assignee: CT Time SA, La Chaux-de-Fonds (CH)

( * ) Notice: Subject to any disclaimer, the term of this patent is extended or adjusted under 35 U.S.C. 154(b) by 233 days.

(21) Appl. No.: 12/863,481

(22) PCT Filed: Jan. 30, 2009

(86) PCT No.: PCT/EP2009/051052

§ 371 (c)(1),
(2), (4) Date: Jul. 19, 2010

(87) PCT Pub. No.: WO2009/095465

PCT Pub. Date: Aug. 6, 2009

(65) Prior Publication Data

US 2010/0290321 A1 Nov. 18, 2010

(30) Foreign Application Priority Data

Jan. 31, 2008 (EP) ..... 08101185

(51) Int. Cl.
*G04B 19/02* (2006.01)

(52) U.S. Cl. ..... 368/220

(58) Field of Classification Search ..... 368/28, 368/35, 37, 80, 223, 228, 220
See application file for complete search history.

(56) References Cited

U.S. PATENT DOCUMENTS

| | | | | |
|---|---|---|---|---|
| 7,310,288 | B2 * | 12/2007 | Simonian | 368/76 |
| 7,420,885 | B2 * | 9/2008 | Claret et al. | 368/265 |
| 2007/0097794 | A1 | 5/2007 | Suzuki | |
| 2010/0246341 | A1 * | 9/2010 | Papi et al. | 368/172 |

FOREIGN PATENT DOCUMENTS

| | | | |
|---|---|---|---|
| CH | 72 648 | A | 11/1916 |
| EP | 0 354 194 | A1 | 2/1990 |
| EP | 1 826 636 | A1 | 8/2007 |

OTHER PUBLICATIONS

International Search Report, dated Jun. 19, 2009, from corresponding PCT application.
European Search Report, dated Oct. 28, 2008, from corresponding European application.

* cited by examiner

*Primary Examiner* — Edwin A. Leon
(74) *Attorney, Agent, or Firm* — Young & Thompson

(57) ABSTRACT

A timepiece movement for varying the arrangement of the different displays includes a first module provided with a first frame and at least a first mobile rotatingly mounted on the first frame, a second module provided with a second frame and at least a second mobile rotatingly mounted on the second frame, the first and second mobiles being kinematically connected to each other, elements for positioning and elements for attaching the modules to each other and associated with the first and second frames. The positioning elements are placed concentrically relative to the rotation axis of one of the first and second mobiles, and are arranged for allowing the relative positioning of the two modules in several angular positions relative to the rotation axis of the mobile to which the positioning elements are concentric. One of the first and second modules is a base module including a platen and a barrel, the barrel defining the first and the second mobile.

12 Claims, 8 Drawing Sheets

MODULAR TIMEPIECE MOVEMENT

TECHNICAL FIELD

The present invention concerns a timepiece movement comprising a first module provided with a first frame and at least a first wheel assembly rotatingly mounted on the first frame, a second module provided with a second frame and at least a second wheel assembly rotatingly mounted on the second frame, the first and second wheel assemblies being kinematically connected to each other, positioning means and means for fastening the modules to each other, associated with the first and second frames, said positioning means being arranged concentrically to the axis of rotation of one of said first or second wheel assemblies and being arranged to allow relative positioning of the two modules in several angular positions in reference to the axis of rotation of the wheel assembly to which the positioning means are concentric.

BACKGROUND OF THE INVENTION

Such a timepiece movement is for example shown in patent application EP 0 354 194. This document describes a timepiece comprising a movement forming a first module mounted in a case and including an arbor defining the axis of the movement. This first module comprises a wheel whereof the axis of rotation is the axis of the movement, said wheel constituting the first wheel assembly. The piece also comprises a second module to display the time, and including an arbor defining the axis of the module. This second module comprises a wheel cooperating with the wheel of the movement, and constituting the second wheel assembly. The display module is fastened to the case and to the movement using coupling elements that are arranged symmetrically around the axis of the case in order to allow the axis of the display module to be arranged in different positions having the same eccentricity around the axis of the case.

If the movement manufacturer wishes to differently position elements of the movement other than those of the display module, it is necessary to design another structure of the movement and as a result another plate, the holes of which will have been adapted for this new arrangement. This requires the manufacturer to design, manufacture and store as many plates as there are positioning alternatives of the different elements.

Other solutions have been proposed in order to be able to vary the time display. Thus, "multi-function" plates were developed. Such a plate is for example described in patent application EP 1 826 636. The plate is designed such that different complementary dials and the corresponding display mechanisms can be present or not present on the main dial around hands displaying the time, depending on the manufacturer's wishes. However, this solution requires that the displays one wishes to use always be positioned at the same locations. If one wishes to change the arrangement of the complementary displays, it is again necessary to provide for as many plates as there are positioning alternatives of the different elements.

One aim of the present invention is therefore to offset these drawbacks, by proposing a timepiece movement making it possible to vary the arrangement of the different displays depending on the manufacturer's wishes, using the same plate, and without having to modify its design.

BRIEF DESCRIPTION OF THE INVENTION

To this end, and according to the present invention, proposed is a timepiece movement comprising a first module provided with a first frame and with at least a first wheel assembly rotatingly mounted on the first frame, a second module provided with a second frame and at least a second wheel assembly rotatingly mounted on the second frame, the first and second wheel assemblies being kinematically connected to each other, positioning means and means for fastening the modules to each other, associated with the first and second frames, said positioning means being arranged concentrically to the axis of rotation of one of said first or second wheel assemblies and being arranged to allow a relative positioning of the two modules in several angular positions in reference to the axis of rotation of the wheel assembly to which the positioning means are concentric.

According to the invention, one of said first and second modules is a basic module comprising a plate and a barrel, said barrel constituting the first, second wheel assembly, respectively.

Thus, the manufacturer then only has a single type of module to manufacture and store. The different movement models can be realized from same first and second modules and differ by modifying the relative positioning of the two modules depending on the different angular positions relative to each other.

Advantageously, said positioning means can comprise a plurality of orifices distributed concentrically to the first wheel assembly, and at least one foot arranged to be able to be engaged in said orifices, the orifices and the foot being arranged some on the frame of the first module, the others on the frame of the second, and arranged to cooperate with the fastening means. In particular, the positioning means can comprise pillars fastened on the frame of the second module and extended by a foot arranged to be engaged in one of the orifices distributed on the frame of the first module.

According to the alternatives, said orifices can assume the form of continuous oblong annular segments or be discrete, of a shape with axial symmetry, round for instance.

Advantageously, the movement according to the invention can also comprise means for displaying the hours and minutes, and positioning organs of said means for displaying the hours and minutes, arranged concentrically to the first wheel assembly and arranged to allow positioning of the means for displaying the hour and the minutes according to several angular positions around the first wheel assembly.

In this case, the movement can comprise connecting means arranged to allow a kinematic connection between the first wheel assembly and the means for displaying the hour and the minutes, regardless of the position of the means for displaying the hour and the minutes around the first wheel assembly.

The movement can also comprise a setting mechanism arranged to cooperate with the means for displaying the hour and minutes, regardless of the position of the means for displaying the hour and minutes around the first wheel assembly.

According to one preferred embodiment, the first module can be a basic module comprising a plate having a central axis, and a barrel, said barrel constituting the first wheel assembly. Preferably, the barrel is mounted on the central axis of the plate.

Advantageously, the means for displaying the hour and minutes can be kinematically connected to the barrel, without kinematic connection with the second module.

The second module can comprise at least one going train kinematically connected to the first wheel assembly and one of the different wheel assemblies of which can constitute the second wheel assembly. In particular when the barrel is mounted at the center of the plate, the going train can be kinematically connected to the barrel, and the center wheel can constitute the second wheel assembly.

The present invention also concerns a timepiece comprising a movement as described above.

BRIEF DESCRIPTION OF THE DRAWINGS

Other features of the present invention will appear more clearly upon reading the following description, done in reference to the appended drawings, in which.

DETAILED DESCRIPTION OF THE INVENTION

Figure 1:
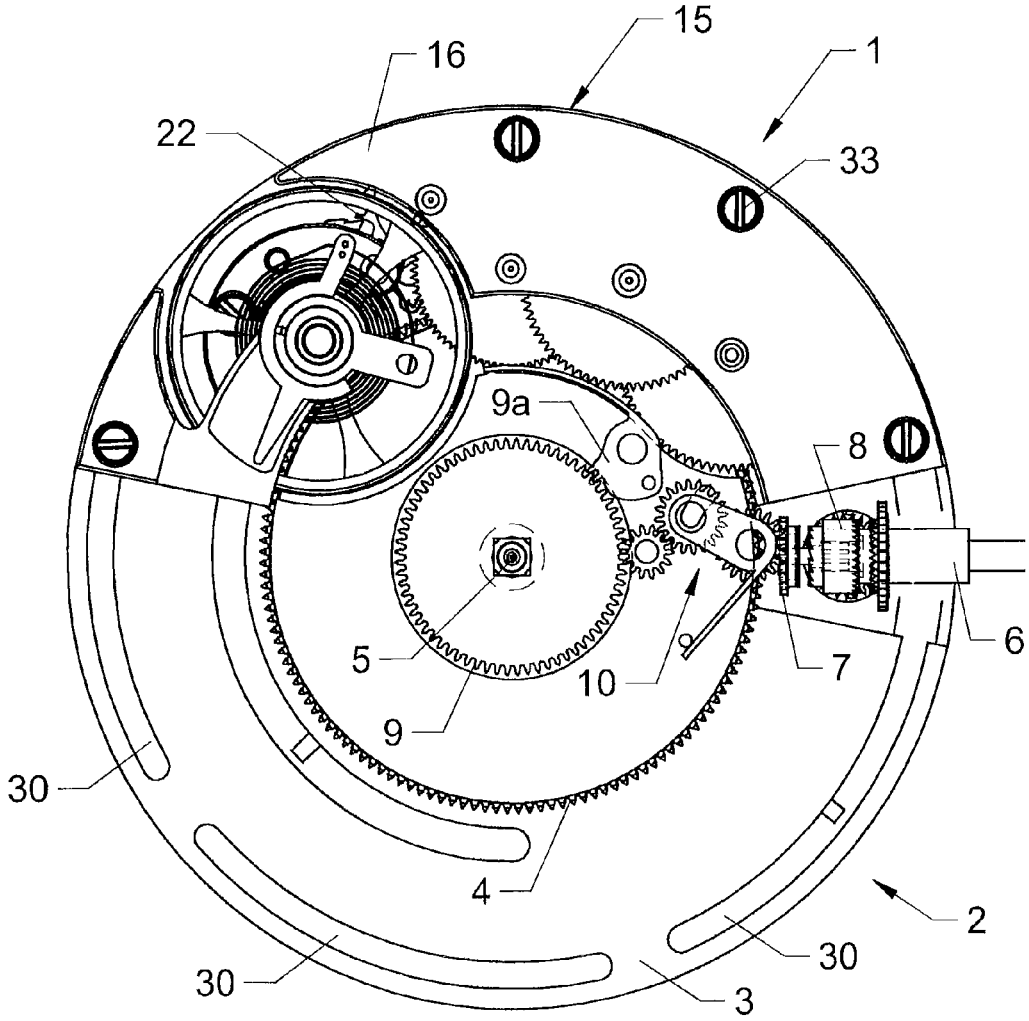
FIG. 1 is a bottom view of a movement according to the invention.

A first alternative of a timepiece movement is shown in FIGS. 1 to 5.

According to this alternative, the movement 1 comprises a first module, subsequently referred to as the basic module 2, which comprises a plate 3 part of a first frame, and a barrel 4 housing a spring and constituting the first wheel assembly, rotatingly mounted on the central axis 5 of the plate 3. It is quite obvious that the plate can be in drum or bar form, the barrel being able to be offset relative to the center.

In the illustrated alternative, the basic module 2 also comprises a winding stem 6 classically performing the winding functions of the barrel spring and setting of the hands. For this, the winding stem 6 for example comprises a winding pinion 7 and a castle-wheel 8 making it possible to implement one or the other of the functions of the winding stem 6.

It is quite obvious that, in other alternatives of the invention, the winding stem can belong to another module, independent from the basic module 2.

In reference more particularly to FIG. 1, the winding mechanism of the barrel spring is classic. It more specifically comprises a ratchet wheel 9 and a pawl 9*a* cooperating with the ratchet wheel 9 to prevent it from withdrawing, the ratchet wheel 9 being kinematically connected with the winding pinion 7 via a setting wheel train 10. This mechanism is known by those skilled in the art and will not be described in more detail.

Figure 2:
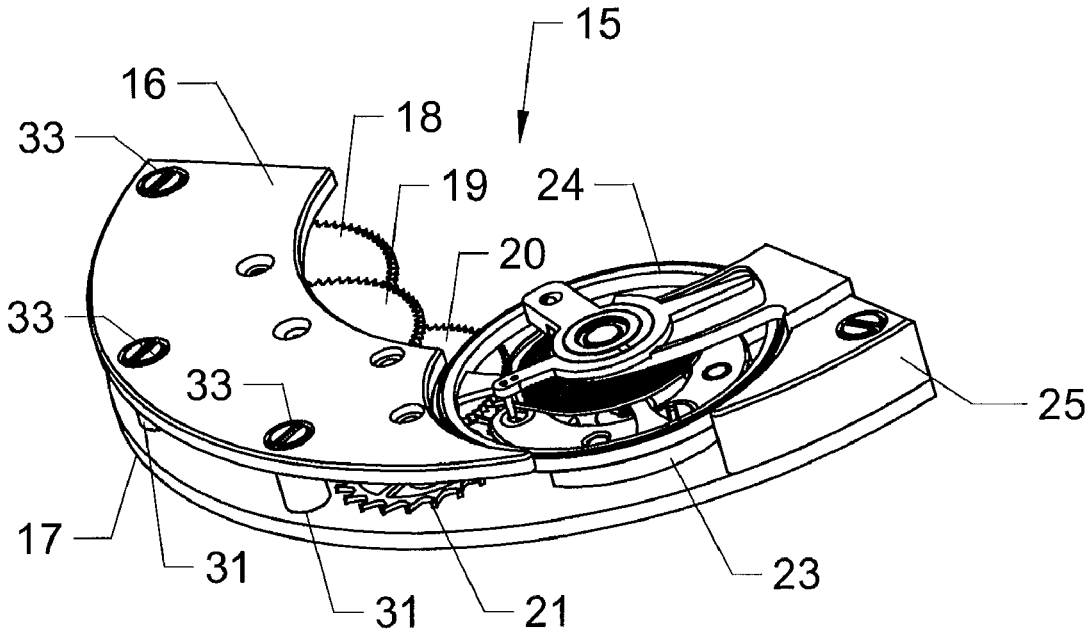
FIG. 2 is a perspective view of a second module according to the invention.

The movement 1 according to the invention comprises a second module, subsequently referred to as the going train module 15, shown more particularly in FIG. 2.

This going train module 15 comprises an upper going train module plate 16 and a lower going train module plate 17, in annular sector form, constituting the second frame. A going train, comprising a center wheel 18, a third wheel 19 and a second wheel 20 and the associated pinions, is rotatingly mounted between the upper 16 and lower 17 going train module plates. The center pinion is arranged to mesh with the barrel 4 and constitutes, with the center wheel, the second wheel assembly. Between the upper 16 and lower 17 going train module plates is also rotatingly mounted an escapement wheel assembly 21. The going train module 15 also comprises a pallet 22 rotatingly mounted between a pallet cock 23 and the lower going train module plate 17, and a sprung balance 24 rotatingly mounted between a balance cock 25 and the lower going train module plate 17. All of these elements are known in themselves and will not be described in more detail.

The going train module 15 is mounted on the lower face of the plate 3 owing to positioning means and to fastening means associated with the plate 3 of the basic module 2 and the frame of the going train module 15.

According to the invention, said means for positioning the going train module comprise:

- a plurality of orifices 30 realized on the plate, distributed concentrically to the barrel 4, and arranged to be able to situate the going train module 15 around the barrel 4 according to different angular positions,
- several pillars 31 fastened to the frame of the going train module 15 and each comprising a foot 32 arranged to be able to be engaged in one of the orifices 30 of the plate 3, chosen as a function of the desired positioning of the going train module 15.

Figure 8:
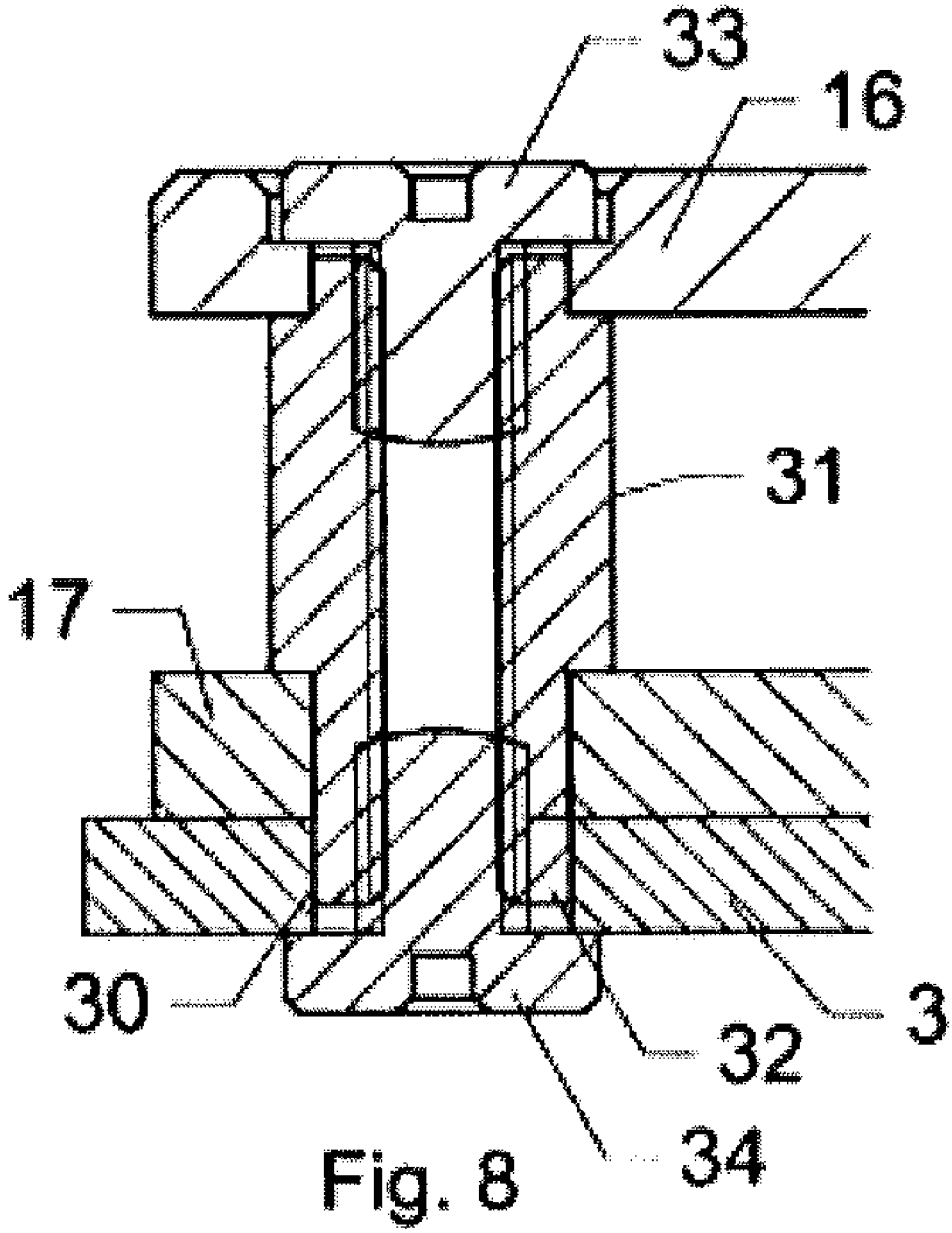
FIG. 8 shows a cross-sectional view of the pillar used in the invention for the assembly of the modules.

As shown more precisely in FIG. 8, the pillar 31 is fastened to the upper going train module plate 16 via a screw 33. Cleverly, the pillar 31 is extended by its foot 32 arranged so as to be able to be engaged first in an orifice of the lower going train module plate 17, then adjusted in an orifice 30 of the opposite plate 3. The assembly is maintained by a screw 34. The pillar 31 and its foot 32 are arranged to cooperate with the screws 33 and 34, which constitute the means for fastening the modules 2 and 15 together.

The orifices 30 assume the form of continuous oblong segments. It is quite obvious that they can also be discrete, and for example assume the form of circular holes distributed over the entire perimeter of the plate 3 concentrically to the barrel 4, with a frequency such that the feet 32 can be engaged there in several positions.

Figure 3:
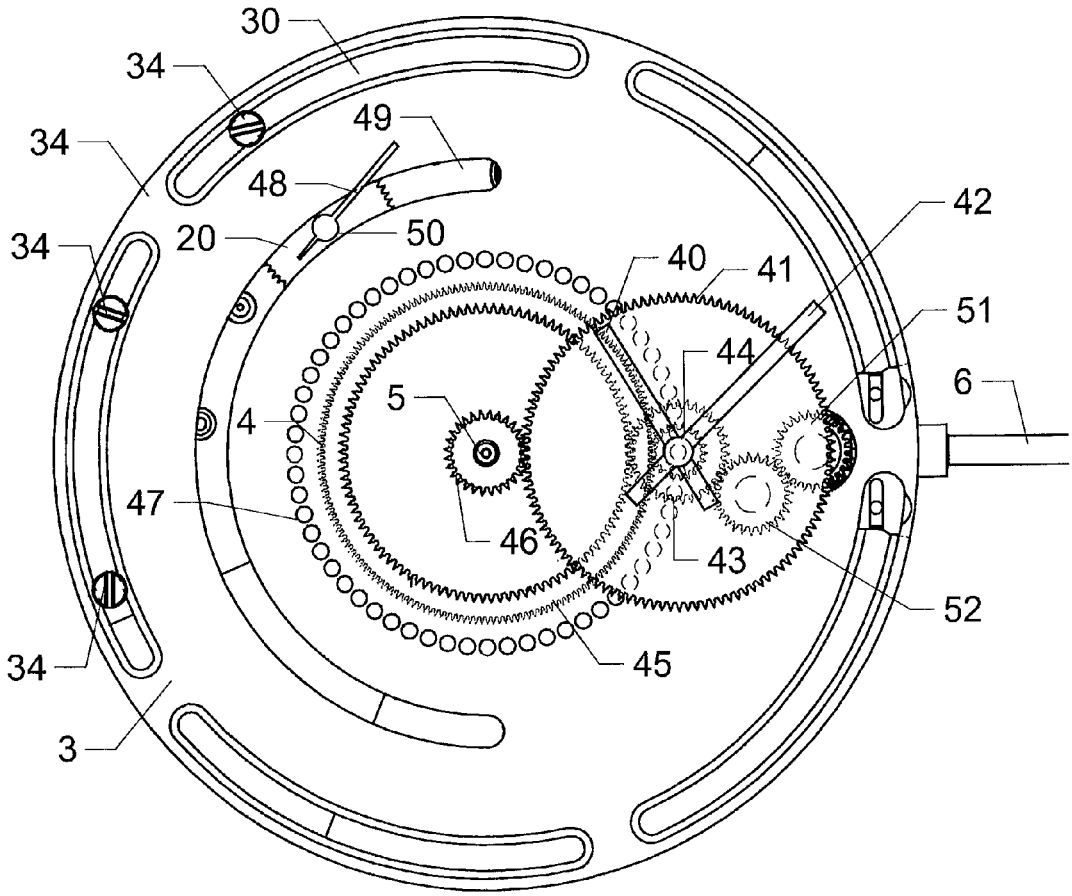
FIG. 3 is a top view of an alternative of a movement according to the invention, the hands being at 3 o'clock.
Figure 4:
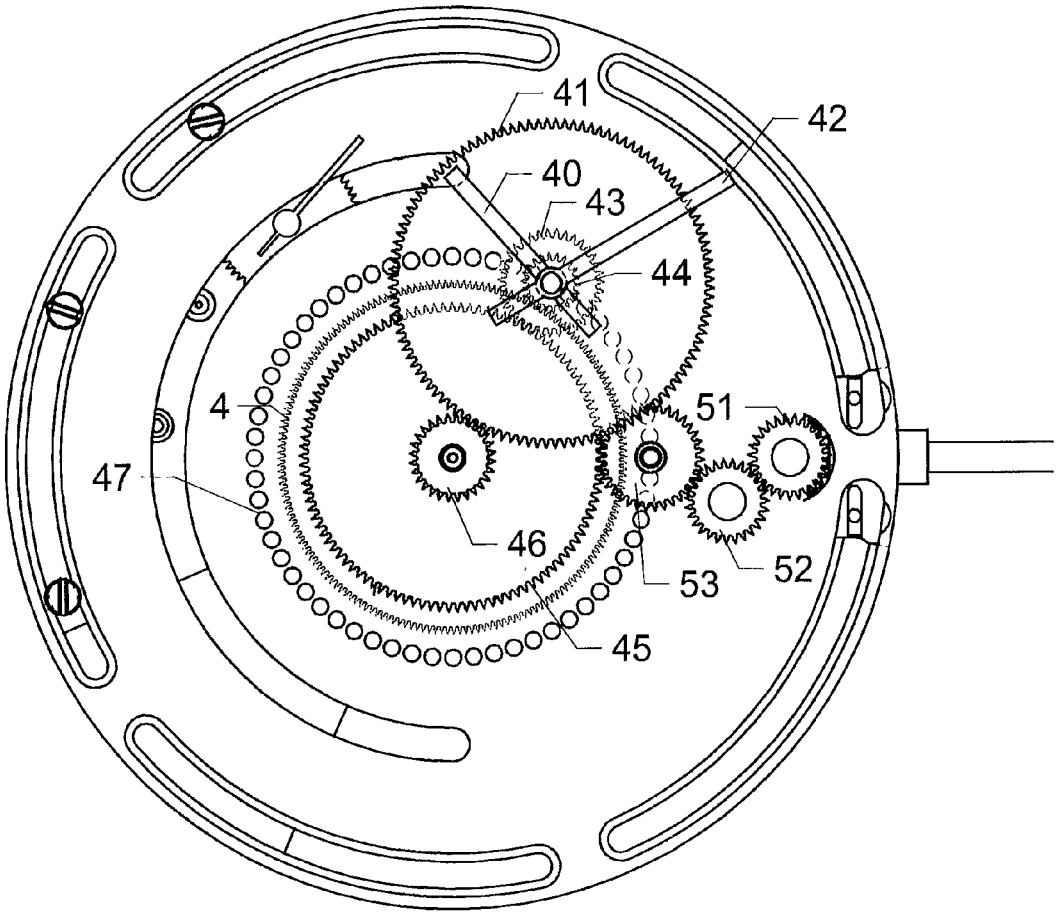
FIG. 4 is a view similar to FIG. 3, but the hands being in another position.
Figure 5:
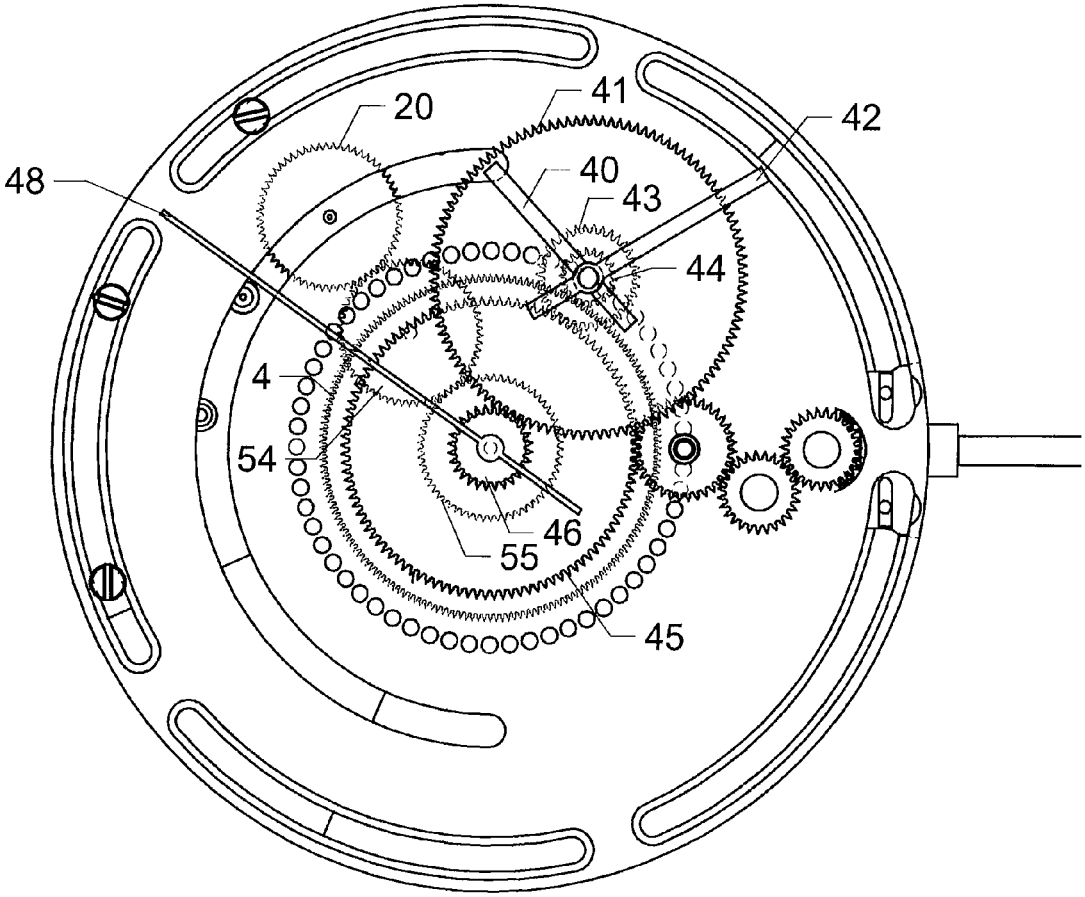
FIG. 5 is a view similar to FIG. 4, but the second hand being in the center.

In reference more specifically to FIGS. 3 to 5, the movement 1 according to the invention also comprises means for displaying the hour and minutes, and positioning organs of those display means, arranged concentrically to the barrel 4 and arranged to allow positioning of the means for displaying the hour and minutes according to several angular positions around the barrel 4.

The means for displaying the hour and minutes comprise connecting means providing the kinematic connection with the barrel 4, regardless of the position of the means for displaying the hour and minutes around the barrel 4.

In reference more specifically to FIG. 3, which illustrates a first possible position of the means for displaying the hour and minutes placed at 3 o'clock, the means for displaying the hour and minutes comprise an hour hand 40 supported by an hour wheel 41, a minute hand 42 supported by a cannon-pinion 43, which is assembled to a pinion 44 by indenting. The pinion 44 is arranged to mesh with the barrel 4. Moreover, a minute wheel 45 and a minute-pinion 46 are provided rotatingly mounted on the axis 5 of the plate 3 which ensure the kinematic connection between the barrel 4 and the means for displaying the hour and minutes, without connection with the going train. The minute-pinion 46 is arranged to mesh with the hour wheel 41 and the minute wheel 45 is arranged to mesh with the cannon-pinion 43.

The positioning organs 47 include an axis designed to support the indented pinion 44 and the cannon-pinion 43, and circular orifices distributed in a circle arc on the plate 3 around the barrel 4 and arranged to receive that axis, according to different positions relative to the barrel 4.

In this alternative, the second is displayed via a second hand 48 supported by the second wheel 20 of the going train module 15, and provided with an axis 50. The going train module 15 was positioned on the plate 3 at the appropriate location to obtain the desired position of the second wheel 20. A recess 49 allowing the passage of the axis 50 of the second hand 48 is then provided in the plate 3. The recess 49 is in the shape of an annular segment, concentric to the barrel 4, in order to be able to modify the position of the second hand 48 as a function of the position of the going train module 15, as will be seen later.

Also provided is a setting mechanism arranged to cooperate with the means for displaying the hour and minutes, regardless of the position of those means around the barrel 4.

This mechanism classically comprises the winding stem 6, elements allowing the movement of the castle-wheel 8 until it meshes with a first setting wheel 51. The latter meshes with a second setting wheel 52 that is arrange to mesh with the cannon-pinion 43.

During the normal operation of the movement 1, the barrel 4 meshes with the indented pinion 44 which is then integral with the cannon-pinion 43 that drives the minute hand 42. The cannon-pinion 43 meshes with the minute wheel 45 and its minute-pinion 46 meshes with the hour wheel 41 that drives the hour hand 40.

For setting, the castle-wheel 8 of the winding stem 6 is positioned so as to mesh with the setting wheel 51, which meshes with the setting wheel 52. To adjust the minutes, the latter meshes with the cannon-pinion 43 which, due to the indenting, rotates on the indented pinion 44 without driving it. The cannon-pinion 43 meshes with the minute wheel 45 driving the minute-pinion 46 which cooperates with the hour wheel 41 to adjust the hours.

It is obvious that the number of setting wheels can vary depending on the dimensions and arrangement of the means for displaying the hour and minutes.

FIG. 4, for example, shows a movement for which the means for displaying the hour and minutes were placed in a position other than that shown in FIG. 3, by arranging the axis of the cannon-pinion 43 and the indented pinion 44 in another orifice 47 around the barrel 4. All of the parts are identical to those shown in FIG. 3. Moreover, an additional setting wheel 53 is provided that provides the kinematic connection between the second setting wheel 52 and the minute wheel 45.

It is possible to place the second hand 48 at the center of the plate 3, as shown in FIG. 5, the other references also being identical to those of FIGS. 3 and 4. In this case, a setting wheel 54 is provided cooperating with the second wheel 20 of the going train module 15 and a second wheel 55 rotatingly mounted at the center of the plate 3.

Figure 6:
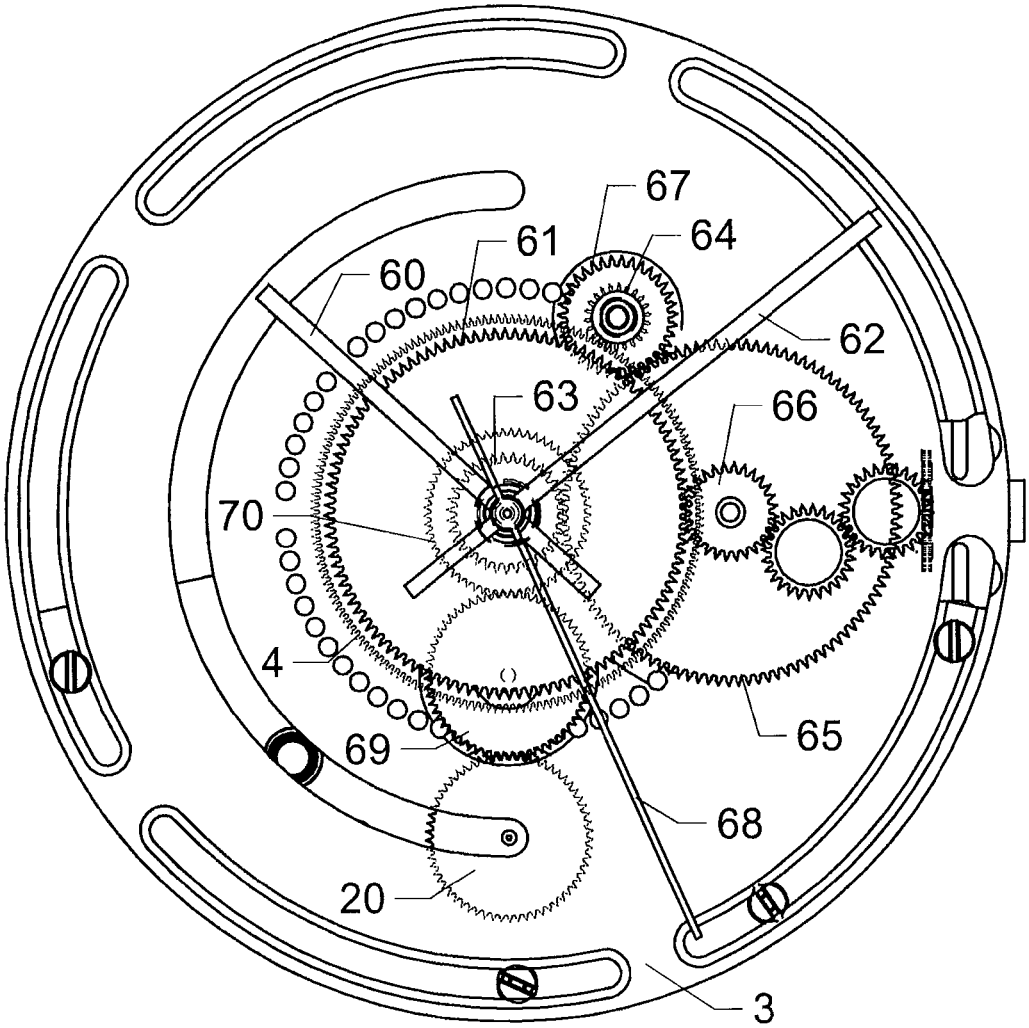
FIG. 6 is a top view of another alternative of a movement according to the invention, the hands being in the center.
Figure 7:
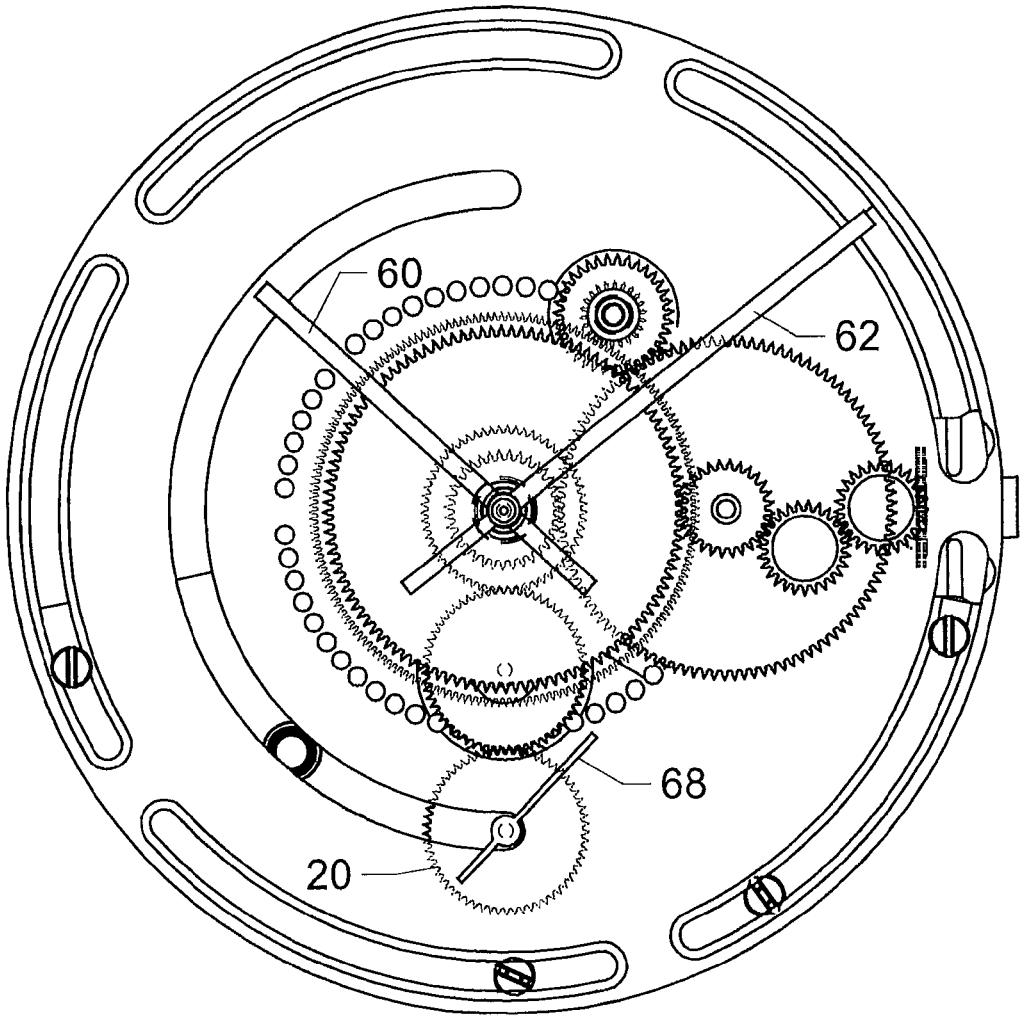
FIG. 7 is a view similar to FIG. 6, but the second hand being at 6 o'clock.

FIGS. 6 and 7 show another alternative of a movement according to the invention, for which the means for displaying the hour and minutes are situated at the center of the plate 3. In this case, said means for displaying the hour and minutes comprise an hour hand 60 supported by the hour wheel 61, a minute hand 62 supported by the cannon-pinion 63. The barrel 4 cooperates with a pinion 64 assembled to a setting wheel 67 by indenting. The setting wheel 67 meshes with a minute wheel 65 integral with a minute-pinion 66, which together form a motion-work that can be rotatingly mounted in one of the orifices provided on the plate 3. The minute-pinion 66 is arranged to mesh with the hour wheel 61 and the minute wheel 65 is arranged to mesh with the cannon-pinion 63.

The second hand 68 is also placed at the center of the plate 3. For this, the going train module 15 has been moved and positioned on the plate 3 such that the second wheel 20 is at 6 o'clock. A setting wheel 69 is then provided cooperating with the second wheel 20 of the going train module 15 and a second wheel 70 rotatingly mounted at the center of the plate 3.

In the alternative illustrated in FIG. 7, the references being identical to those of FIG. 6, the second hand 68 is for example positioned at 6 o'clock and is directly supported by the second wheel 20 of the going train module 15. The setting wheel 69 and the second wheel 70 are then no longer necessary.

According to the invention, the second hand can occupy different positions relative to the barrel 4. For this, the going train module 15 can be arranged on the lower face of the plate 3, according to different positions, around the barrel 4, by introducing the feet 32 of the pillars 31 of the going train module 15 in the orifices 30 of the plate 3 at the desired locations, and by screwing them using screws 33 and 34.

Moreover, the means for displaying the hour and minutes can be arranged on the upper face of the plate 3, according to different positions, around the barrel 4, by introducing the axis of the cannon-pinion into the orifice of the plate 3 at the desired location.

Thus, the movement can have different configurations, using a single plate and by modifying a minimum number of pieces.

In the alternative illustrated here, the going train module and the means for displaying the hour are on either side of the plate, but it is obvious that they can be arranged on the same side. The movement can also comprise a retrograde display on either side of the plate.

A person skilled in the art knows how to adapt the dimensions and the number of teeth of the different wheel assemblies and setting wheels to respect the kinematic connections between the different elements and the speeds of rotation of the different wheel assemblies, regardless of the positions of the going train module and the means for displaying the hour and minutes, around the barrel.

It is obvious that the modules can present other functions, such as power reserve modules, modules for displaying the date, time zones, or chronograph modules, comprising a wheel assembly in kinematic connection for example with the barrel. These modules can then be used separately or in combination, and be arranged on the plate or relative to other modules without it being necessary to change the plate or modules.

It is also obvious that the invention is not limited to the example described, and that the basic module comprising the barrel can be positioned such that the barrel is not at the center of the movement. Likewise, it is obvious that the positioning means of the modules can be arranged concentrically to the axis of rotation of the wheel assembly of another module, different from the barrel, the module comprising the barrel then being able to occupy several angular positions in reference to the axis of rotation of this wheel assembly to which the positioning means are concentric.

Thus, owing to the features of the movement according to the invention, it is possible to produce movements allowing the display of different functions, in combinations or independently of each other, the display being able to be done at different locations of the dial, without, however, making changes to the frame.

The invention claimed is:

1. A timepiece movement comprising a first module provided with a first frame and at least a first module rotatingly mounted on the first frame, a second module provided with a second frame and at least a second wheel assembly rotatingly mounted on the second frame, the first and second wheel assemblies being kinematically connected to each other, positioning means and means for fastening the modules to each other, associated with the first and second frames, said positioning means being arranged concentrically to the axis of rotation of one of said first or second wheel assemblies and being arranged to allow relative positioning of the two modules in several angular positions in reference to the axis of rotation of the wheel assembly to which the positioning means are concentric, wherein one of said first and second modules is a basic module comprising a plate and a barrel, said barrel constituting the first, second wheel assembly, respectively.

2. The movement according to claim 1, wherein said positioning means comprise a plurality of orifices distributed concentrically around the first wheel assembly, and at least one foot arranged to be able to be engaged in said orifices, the orifices and the foot being arranged some on the frame of the first module, the others on the frame of the second, and arranged to cooperate with the fastening means.

3. The movement according to claim 2, wherein the positioning means comprise pillars fastened on the frame of the second module and extended by a foot arranged to be engaged in one of the orifices distributed on the frame of the first module.

4. The movement according to claim 2, wherein said orifices assume the form of continuous oblong annular segments.

5. The movement according to claim 2, wherein said orifices are discrete.

6. The movement according to claim 1, wherein it also comprises means for displaying the hour and minutes, and positioning organs of the means for displaying the hour and minutes, arranged concentrically to the first wheel assembly, and arranged to allow a positioning of the means for displaying the hour and minutes according to several angular positions around the first wheel assembly.

7. The movement according to claim 6, wherein it comprises a setting mechanism arranged to cooperate with the means for displaying the hour and minutes, regardless of the position of the means for displaying the hour and minutes around the first wheel assembly.

8. The movement according to claim 1, wherein the first module is a basic module comprising a plate having a central axis and a barrel, said barrel constituting the first wheel assembly.

9. The movement according to claim 8, wherein the barrel is mounted on the central axis of the plate.

10. The movement according to claim 8, wherein the means for displaying the hour and minutes are kinematically connected to the barrel, without kinematic connection with the second module.

11. The movement according to claim 1, wherein the second module comprises at least one going train kinematically connected to the first wheel assembly and one of the different wheel assemblies of which can constitute the second wheel assembly.

12. A timepiece containing a timepiece movement comprising a first module provided with a first frame and at least a first module rotatingly mounted on the first frame, a second module provided with a second frame and at least a second wheel assembly rotatingly mounted on the second frame, the first and second wheel assemblies being kinematically connected to each other, positioning means and means for fastening the modules to each other, associated with the first and second frames, said positioning means being arranged concentrically to the axis of rotation of one of said first or second wheel assemblies and being arranged to allow relative positioning of the two modules in several angular positions in reference to the axis of rotation of the wheel assembly to which the positioning means are concentric, wherein one of said first and second modules is a basic module comprising a plate and a barrel, said barrel constituting the first, second wheel assembly, respectively.

* * * * *